United States Patent [19]

Gray

[11] 3,999,811

[45] Dec. 28, 1976

[54] DRILL PIPE PROTECTOR

[75] Inventor: Charles A. Gray, Cypress, Calif.

[73] Assignee: Bryon Jackson, Inc., Long Beach, Calif.

[22] Filed: Aug. 25, 1975

[21] Appl. No.: 607,314

[52] U.S. Cl. ..... 308/4 A

[51] Int. Cl.[2] ..... F16C 17/00

[58] Field of Search ..... 308/4 R, 4 A; 24/20 R, 24/20 S, 20 TT, 20 EE, 257 R, 256, 259 C; 285/373, 419, 235, DIG. 22; 138/99

[56] References Cited

UNITED STATES PATENTS

| | | | |
|---|---|---|---|
| 3,462,805 | 8/1969 | Quisling | 24/20 EE |
| 3,652,138 | 3/1972 | Collett | 308/4 A |
| 3,894,779 | 7/1975 | Hoon et al. | 308/4 A |

*Primary Examiner*—Philip Goodman
*Assistant Examiner*—Gene A. Church
*Attorney, Agent, or Firm*—John O. Evans, Jr.

[57] ABSTRACT

A drill pipe protector for use on drill pipe and the like having an outer pliant and resilient collar that envelops an insert of composite construction.

8 Claims, 11 Drawing Figures

FIG. 1.
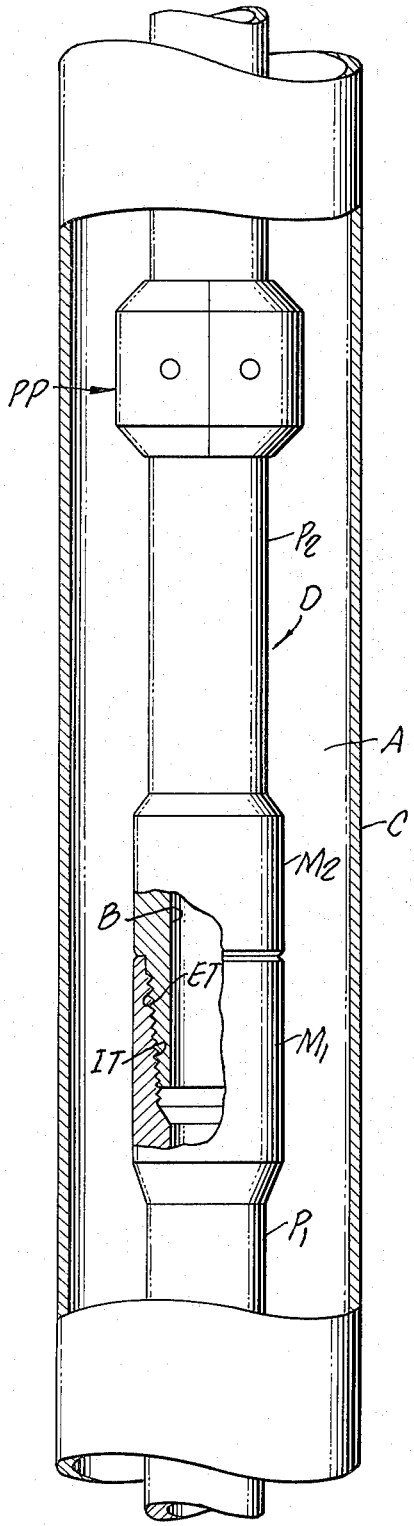
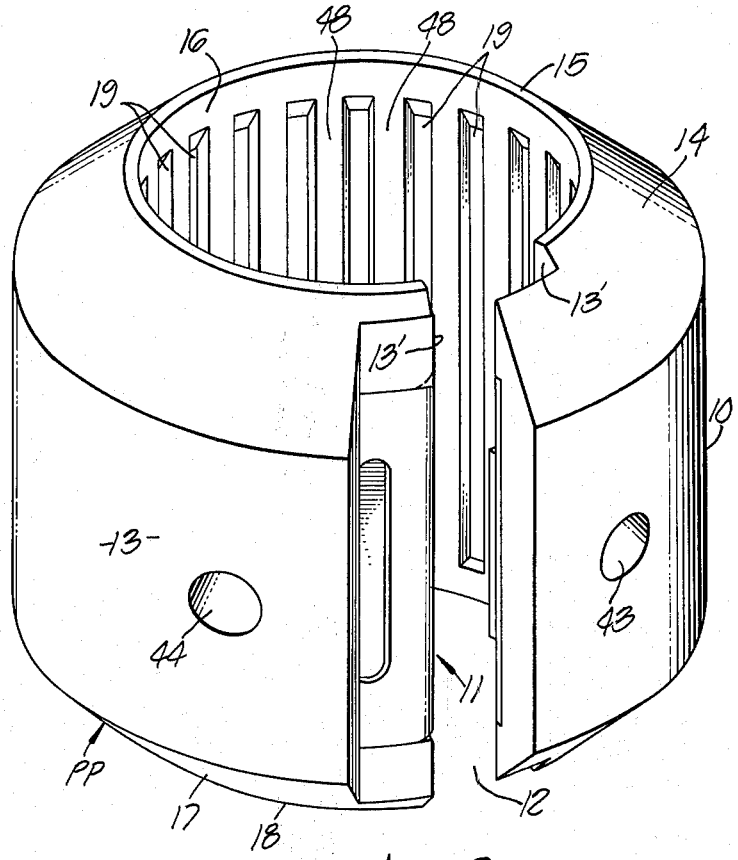
FIG. 2.
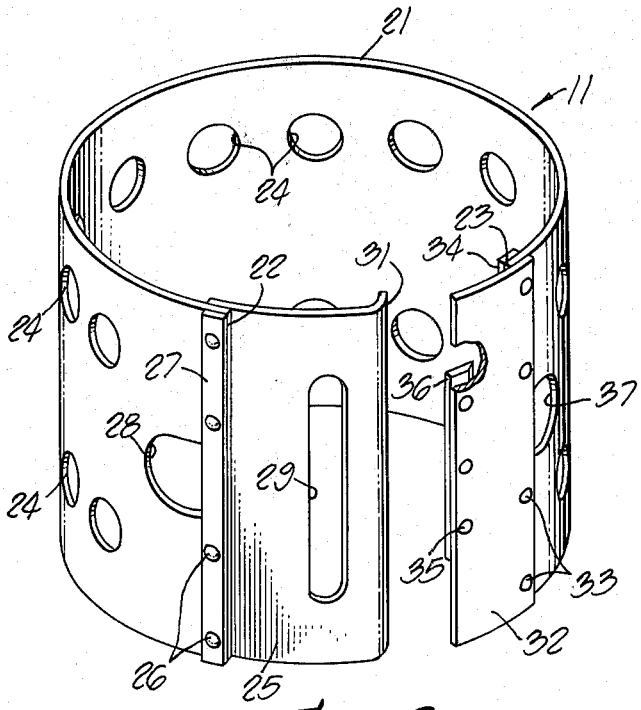
FIG. 3.

FIG. 4.
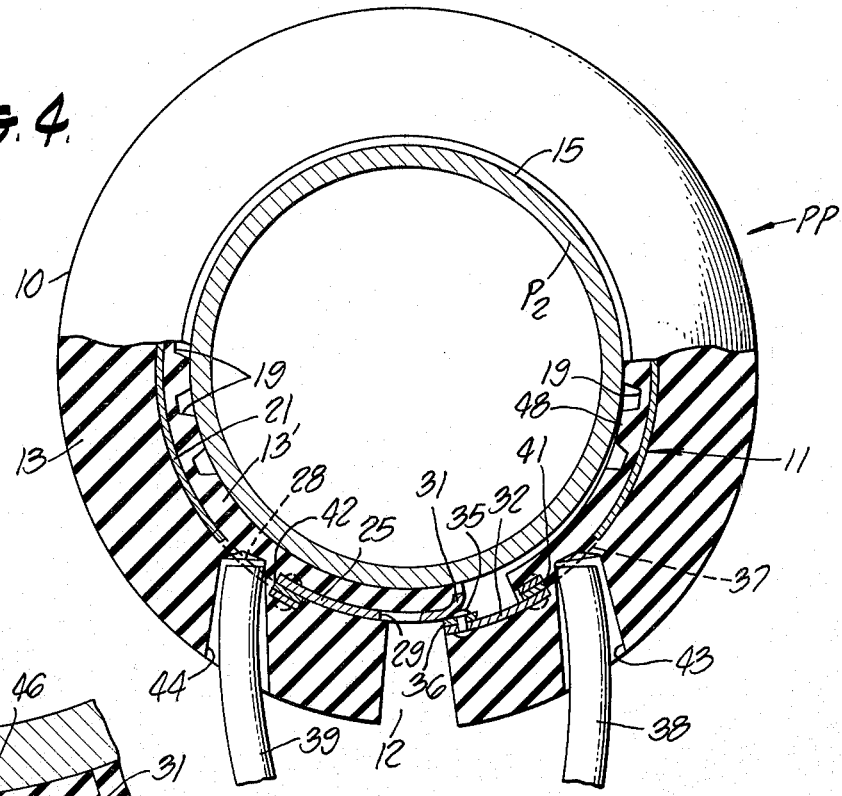
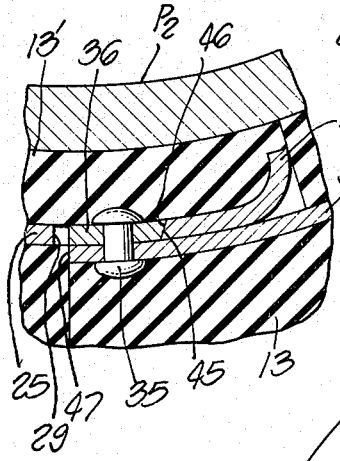
FIG. 6.
FIG. 5.
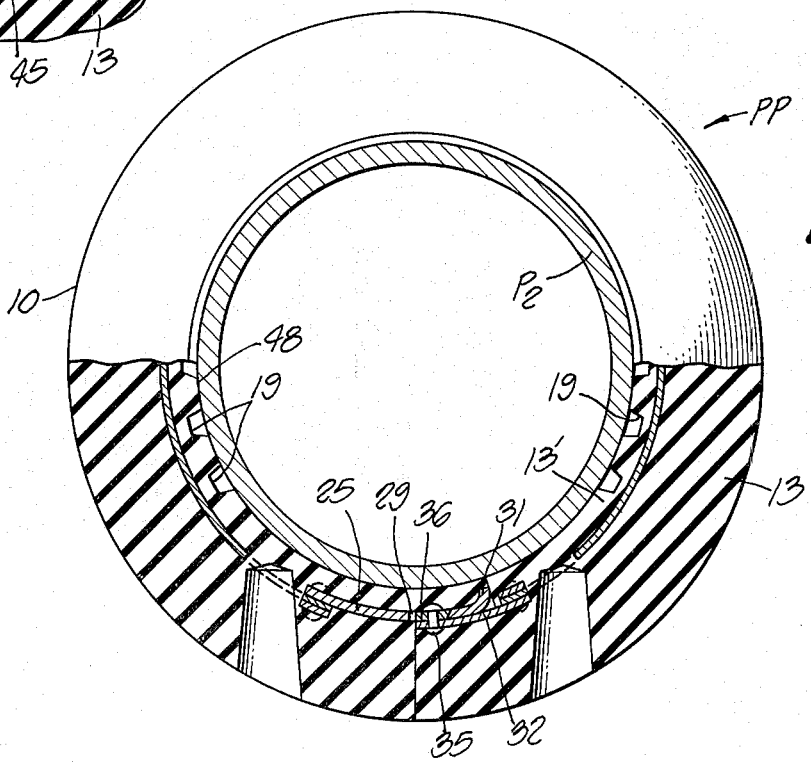

DRILL PIPE PROTECTOR

BACKGROUND OF THE INVENTION

This invention relates to pipe protectors, especially those suited to use on oil well drill pipe and pipe strings for the protection of such pipe and the casing in which the pipe operates.

In the drilling of oil-, gas-, and water wells, it is common practice to place resilient collars at spaced locations along the drill pipe string. Such collars are called pipe protectors. They serve as buffers to cushion impacts and reduce wear between the drill string and the surrounding casing as the drill string is rotated or run into or out of the well.

U.S. Pat. No. 3,652,138, issued Mar. 28, 1972, to Charles H. Collett, for "Self-Locking Snap-on Collar for Oil Well Operations", discloses pipe collars useful in themselves as pipe or rod protectors, or useful as stop collars for longitudinally positioning a relatively rotatable protector on a pipe.

SUMMARY OF THE INVENTION

A principal object of the invention is to provide a drill pipe and casing protector that is quick and easy to install upon and remove from a drill pipe or the like.

A further object is to provide a protector that tenaciously grips the pipe upon which it is installed, and effectively resists forces that tend to dislodge it.

Another object is to provide a protector that minimizes the erosive and corrosive action of the drilling fluid upon the pipe as the fluid flows around the protector in the annulus between the pipe and the casing.

The foregoing and other aims, objects and advantages of the invention are achieved in a pipe protector for use on oil well drill pipe and the like comprising: a longitudinally split, generally cylindrical band of spring steel; a first plate of strong, tough steel; first means affixing said first plate to one end of said band with a portion of said first plate extending beyond said one end; a second plate of strong tough steel; second means affixing said second plate to the other end of said band with a portion of said second plate extending beyond said other end; radially projecting, longitudinally extended, discrete locking means of strong, tough metal affixed to said portion of said first plate and having a width in the circumferential direction substantially greater than its thickness in the radial direction; said portion of said second plate providing longitudinally extended, radial locking recess means adapted to receive said locking means; said band being adapted to be circumferentially contracted to move said plates relative to one another and to slide said locking means along a surface of said second plate until said locking means snaps into said locking recess means and portions of the opposed circumferential surfaces of said plates are in overlapping relation; said locking means and said locking recess means having generally radial faces adapted to abut each other when said locking means is disposed in said locking recess means to prevent circumferential expansion of said band; a longitudinally split, annular collar of pliant, elastic material substantially encasing said band and said plates, the material of said collar terminating short of said overlapping portions of the opposed circumferential surfaces of said plates to expose said portions; and means engageable by an implement for contracting and locking said collar in tightly gripping disposition around a pipe.

BRIEF DESCRIPTION OF THE DRAWINGS

Referring to the drawings:

FIG. 1 is a vertical elevational view, with parts broken away, of a section of a drilling string disposed within a casing, a pipe protector being mounted on the drilling string;

FIG. 2 is an enlarged perspective view of a pipe protector in accordance with the invention and in its unlocked and relaxed condition;

FIG. 3 is a perspective view of an insert like that embedded in the elastomeric collar of the pipe protector of FIG. 2, the insert being unlocked and in relaxed condition;

FIG. 4 is a plan view, with parts broken away, of the pipe protector of FIGS. 2 and 3 partially contracted around a section of pipe preparatory to its being fully contracted and locked tightly on the pipe, the jaws of an installation tool being shown in operative position;

FIG. 5 is a view similar to FIG. 4, but showing the pipe protector tensioned into position on the pipe, the pipe tool jaws being omitted;

FIG. 6 is an enlarged fragmentary sectional view of the lock portion of the protector in locked condition;

DESCRIPTION OF THE PREFERRED EMBODIMENTS

Figure 7:
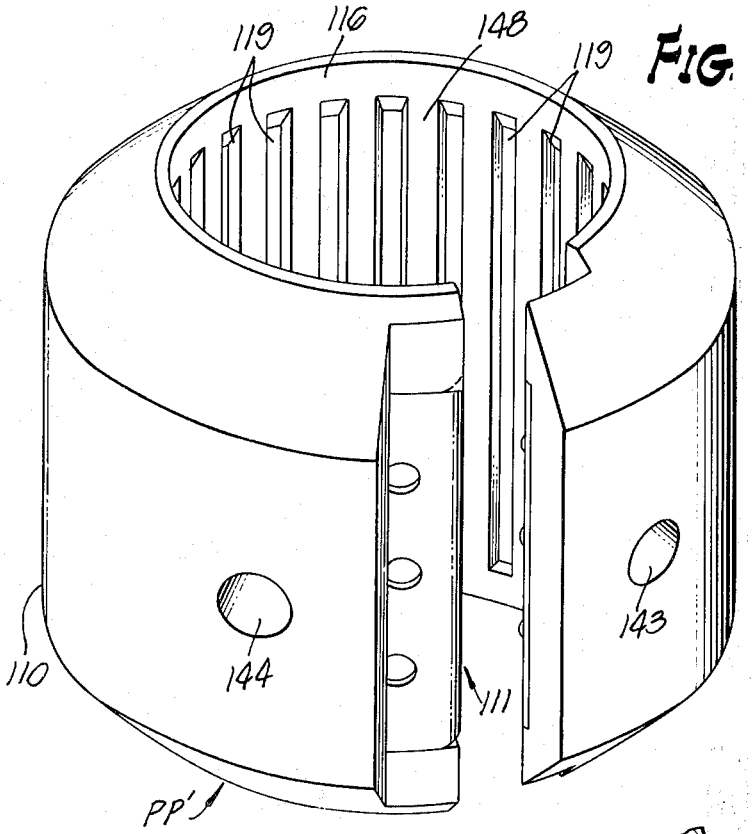
FIG. 7 is a perspective view similar to that of FIG. 2 of another form of pipe protector in accordance with the invention.

Referring to the drawings, particularly to FIG. 1, there is shown a section of well casing C. It will be understood that the casing typically is cemented into a well bore (not shown) extending down into the earth. A drilling string, designated by the general reference character D, is disposed inside the casing. The drilling string is formed of a number of sections of drill pipe, only two of which $P_1$ and $P_2$ are shown by way of illustration. The upper end of the lower pipe section $P_1$ is provided with the usual box coupling member $M_1$, which has an internal, tapered female-threaded portion IT. The lower end of the immediately superjacent pipe section $P_2$ has a pin coupling member $M_2$, complementary to the box coupling member. The pin coupling member has an external, tapered male-threaded portion ET that is screwed into the complementary threads of the box member to couple the pipe sections to each other. It will be understood that similar pipe sections above and below those shown in FIG. 1 are coupled into the string by means of pin-and-box joints like those shown.

At the bottom of the drilling string there is mounted a drilling bit (not shown). The drilling string is rotated by a conventional rotary table drive (not shown) located at the earth's surface, to thereby turn the drilling bit and drill the well deeper into the earth. Drilling mud is circulated by mud pumps in the usual way down through the bore B of the drill string, out through openings in the drill bit, and up through the annulus A between the drill string D and the casing C.

A pipe protector PP constructed in accordance with the invention, is shown as mounted on the drill pipe section $P_2$, preferably close to the pipe joint $M_1M_2$. Such protector has a pliant, elastic outer body of wear-resistant rubber or the like that cushions impacts against the inner walls of the casing as the drill string is rotated and/or moved axially in the casing. Thus, it protects the drill string, especially the joint portions thereof, and the interior of the casing from wear and damage which, without the protector, would result from direct metal-to-metal contact. Protectors may be mounted on each section of pipe in the drill string to obtain maximum protection against damage.

One form or embodiment of the protector of the present invention is generally designated by the reference characters PP in FIGS. 2, 4 and 5. This protector has a longitudinally split collar or body 10 made of a pliant, elastic material, such as rubber, preferably synthetic rubber compounded to have a long service life in the environment of oil or gas wells.

The collar is shown in its unlocked and relaxed condition in FIG. 2. An insert, designated by the general reference numeral 11 (See FIG. 3) is embedded in or encased by the collar 10. A generally longitudinal slit through the collar 10 and insert 11 provides a vertical opening 12 through the wall of the protector which may be expanded to allow the protector to be passed over a pipe for subsequent contraction into tight engagement with the pipe.

The portion 13 of the collar 10 that is disposed radially outwardly of the inset 11 provides a relatively thick cushion of elastomeric material for absorbing impact shocks. This portion has a generally cylindrical vertical, outer surface. The top surface 14 of the casing tapers inwardly as it rises at an angle of about 45° to the vertical, and merges into a narrow annular top end surface 15 surrounding a central, cylindrical, vertical opening 16. The bottom 17 of the casing is tapered as it descends at an angle of about 45° to the vertical to meet a narrow annular bottom end surface 18, similar to the top annular end surface 15.

The portion 13' of the collar 10 that is disposed radially inwardly of the insert 11 is provided with a plurality of longitudinally extending, circumferentially spaced grooves 19. These grooves terminate at their upper ends below the top end surface 15 of the casing, and at their lower ends above the bottom end surface 18.

Referring to FIG. 3, it is seen that the insert 11 is a composite structure having a back band 21 in the form of a section of a right cylinder. This back band is fabricated from good quality spring steel. It is seen in FIG. 3 in its relaxed condition. It has opposed, longitudinally extending edges 22 and 23 that are circumferentially spaced from one another. Upper and lower rows of bonding holes 24 are provided in the back band.

A rectangular female lock plate 25 is affixed to the inner side of one end of the back band by rivets 26, the rivets also fastening a reinforcing strip 27 to the outer side of this end of the back band. An aperture 28 to allow insertion of an installation tool jaw is provided in the back band adjacent to the central portion of the reinforcing strip and the central portion of the riveted edge of the plate 25.

Near the center of the lock plate 25 there is provided a female locking recess 29 which, in the modification shown in FIG. 3, has the form of a longitudinal slot, rounded at its upper and lower ends.

It will be seen that the female lock plate 25 extends from its riveted edge towards the edge 23 of the back band and terminates at its free longitudinal edge in an inturned ramp portion 31, which serves a purpose to be explained hereinafter.

A male lock plate 32 is fastened to the other end of the back band 21 by a longitudinal row of rivets 33. The rivets also are used to fasten a reinforcing strip 34 to the inside surface of said other end of the band. The strip 34 extends from top to bottom of the back band.

Affixed to the free end of the male lock plate 32 by rivets 35 is a longitudinally disposed male lock member in the form of a lock bar 36. A portion of the male lock plate is broken away in FIG. 3 merely for the purpose of showing one end of the lock bar, the latter being rectangular in shape.

Adjacent to the center of the riveted edge of the male lock plate and to the center of the reinforcing strip 34, a second tool jaw aperture 37 is provided in the back band 21.

Turning now to FIG. 4, the pipe protector PP is shown as wrapped around a pipe $P_2$ and partially closed thereon. The closing or tensioning of the protector is effected by an installation tool, the jaws 38, 39 of which are moved towards one another to contract the protector. Such installation tools are well known and need not be further described. In order that the tool jaws may exert force against the reinforced portions 41, 42 of the insert 11, jaw recesses 43 and 44 are provided in the rubber collar. These recesses extend at least partially through the apertures 37, 28 in the back band 21, but stop short of the radially inner surface of the inner portion 13' of the collar. As shown, a small thickness of rubber may lie between the jaws and the reinforced portions 41, 42.

In FIG. 4, it is seen that the lock bar 36 and rivets 35 are in contact with the inturned or ramp portion 31 of the female lock plate 25. As the protector is further contracted into its fully closed position, the rivets 35 ride up the ramp portion and over the surface of the female lock plate until the lock bar 36 snaps into the female locking recess or slot 29. The spring action of the back band 21 and the forces exerted by the jaws 38, 39 hold the rivets 35 in sliding contact with the female lock plate and snap the lock bar into the locking recess.

FIG. 5 shows the pipe protector fully tensioned about the pipe $P_2$ and locked thereon. It is seen that the lock bar 36 is disposed in the complementary lock slot 29, and that portions of the opposed circumferential surfaces of the female lock plate 25 and the male lock plate 32 are in overlapping relation. The joint between the ends of the protector may be described as lap joint.

Moving to FIG. 6, there is shown an enlarged fragment of the lock portion of the protector with the complementary lock elements interengaged. It is seen that the lock bar has a longitudinal face 45 that abuts a complementary face 46 on the female locking means 29. These faces are in abutment for the entire height of the lock bar 36. The faces 45 and 46 are disposed at an acute angle to an intersecting radius of the protector, the angle referably being in the range of 15° to 20°, more or less, with respect to such radius. The face 45 is disposed radially inwardly of the face 46, to thereby oppose radial disengagement of the lock bar from the slot. The face 45 of the lock bar may be said to slope outwardly and towards the free end 47 of the radially outer overlapping plate 32, and the face 46 in the slot 29 may be said to slope outwardly and away from the free end 31 of the radially inner overlapping plate 25.

When the locking parts are engaged, there is very little bending moment applied to the lock bar 36. The circumferential forces applied to the lock bar are transferred to the rivets primarily as shear forces. Thus, a very strong lock arrangement is provided by a lock bar whose circumferential extent is several times greater than its radial extent.

It will be understood that, if desired, the lock bar could be affixed to the radially inner plate member and project outwardly into a complementary slot in the radially outer plate member. Moreover, a ramp, such as the ramp portion 31 could be provided on the free end of the radially outer overlapping plate, if desired.

The lock plates 25 and 32 may be fabricated of any suitable material such as a strong and tough grade of alloy steel. The rivets may be made of a malleable steel alloy. The pliant, elastic casing is applied and bonded to the insert by molding and curing methods common to rubber manufacturing processes. In this regard, the rubber compound on the radially inner side of the insert is united to that on the radially outer side of the insert through the previously described bonding holes 24. As seen in FIG. 1, the elastomeric material of the collar 10 is continuous over the top edge and under the bottom edge of the insert.

The tapered top and bottom ends of the protector provide for smooth flow of drilling fluids and cuttings over and past the protector, thereby minimizing corrosion and erosion of the drill pipe.

The previously described axial grooves 19 provide contact pads 48 (See FIG. 1) on the inner surface of the protector, which pads are compressed when the protector is locked on the drill pipe and which serve to prevent axial and rotational movement of the protector on the drill pipe while permitting easy installation of the protector. Rubber that is displaced when the pads are compressed moves circumferentially, thereby circumferentially narrowing the grooves 19. As pointed out hereinbefore, the grooves 19 stop short of the top and bottom of the protector, whereby, drilling fluid is prevented from flowing between the protector and the drill pipe. If drilling fluid were permitted to flow between the protector and the drill pipe, the latter would be eroded and corroded by the fluid.

The insert 11 of the hereinbefore described protector PP functions extremely well as a component of the protector. The spring back band 21 functions primarily as the required spring element. The lock plates 25 and 32, the lock bar 36 and the reinforcing strips 27 and 34, being made of strong and tough alloy steel, are ideally suited to their respective purposes. The lock bar is not subject to high bending moments. Provision is made for applying the jaws of the installation tool to reinforced and strong areas of the insert. The ramp portion 31 facilitates installation of the protector on a pipe, and its curvature adds strength and rigidity to the free end of the female lock plate 25.

The protector may be removed from a pipe by driving a wedge between the overlapping plates 25 and 32 to force them apart. After the lock bar 36 has been withdrawn from the locking recess 29, the protector is allowed to expand to its relaxed condition. The protector is then removed from around the pipe.

The pipe protector of the invention shown in FIGS. 7 to 10 10 is designated by the general reference character PP'. It is like the pipe protector PP shown in FIGS. 1 to 6 and described hereinbefore, save only that it has a different form of lock means. Therefore, it is not necessary to describe in detail the numerous elements that are common to both pipe protectors. It is pointed out that the pipe protector PP' has an elastomeric collar 110 that encases a composite insert 111.

The collar 110 is provided with longitudinal grooves 119 spaced circumferentially around the central opening 116 to define the longitudinally extending contact pads 148 between successive grooves. The exterior configuration of the collar 110 is like that of the previously described collar 10.

Figure 8:
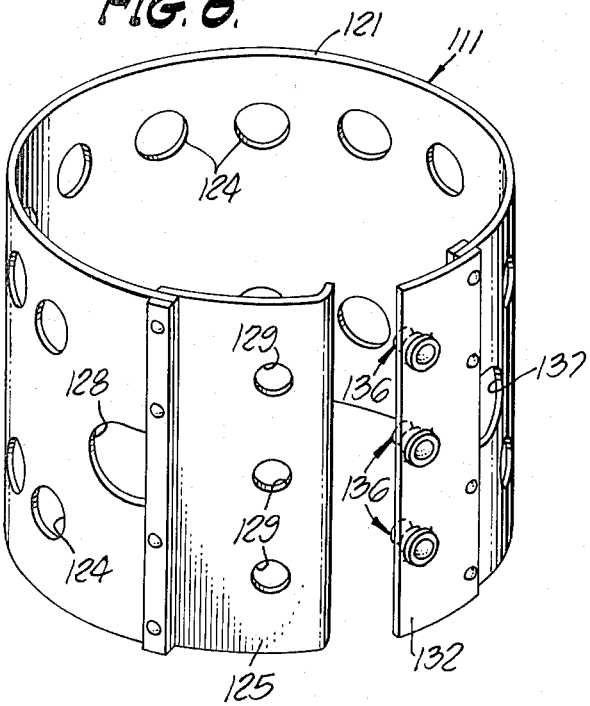
FIG. 8 is a view similar to that of FIG. 3 of an insert as used in the pipe protector of FIG. 7.

As shown to advantage in FIG. 8, the insert 111 has a back band 121 of spring steel having bonding holes 124 therethrough and apertures 128 and 137 to accept the jaws of an installation tool. A female clip or lock plate 125 and a male clip or lock plate 132 are affixed to opposite ends of the back band by elements that are the same as the corresponding elements of the previously described pipe protector. Female locking recess means in the form of vertically spaced circular holes 129 are provided in the female lock plate. Complementary male lock means, in the form of vertically arranged pins designated by the general reference numeral 136 are provided on the male lock plate 132.

Figure 9:
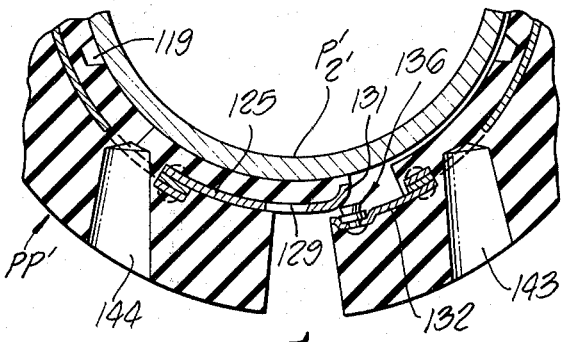
FIG. 9 is a fragmentary, horizontal, medial sectional view of a portion of the pipe protector of FIG. 7 encircling a pipe and partially contracted and ready to be tightened into firm engagement with the pipe.
Figure 10:
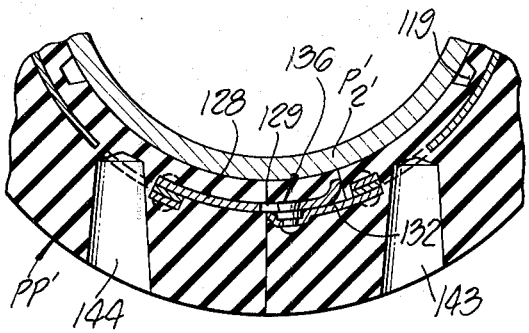
FIG. 10 is a view similar to that of FIG. 9, but showing the pipe protector tensioned about the pipe.

Referring to FIG. 9, which shows the pipe protector PP' partially tightened about the pipe $P'_{2'}$, the pins 136 are illustrated as being engaged with the ramp portion 131 of the female lock plate 125. As the ends of the protector are moved into their fully closed position, the pins slide circumferentially over the radially outer surface of the female lock plate 125. When the pins become aligned with the holes 129, they snap into these holes, and the parts assume the positions shown in FIG. 10, wherein the pins 136 are shown as received in the holes 129, and portions of the male and female lock plates are in contact.

Figure 11:
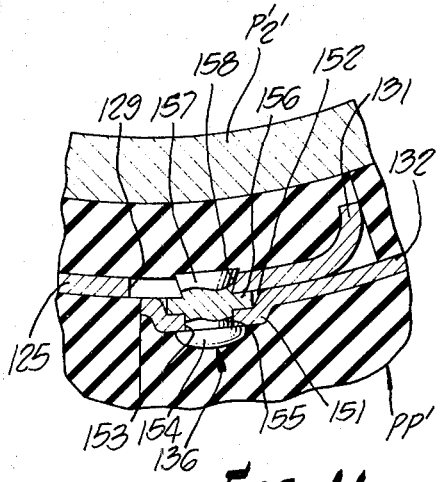
FIG. 11 is an enlarged fragmentary sectional view of the lock portion of the protector of FIG. 7 in locked condition.

Turning now to FIG. 11, which shows, in section, the lock portion of the protector PP', the male lock plate 132 is seen to have an upset portion 151 which provides a circular depression 152 in the radially inner surface of the male lock plate. A hole 153 is provided in the center of the upset portion. The pin 136 is, in effect, a rivet having an upset head 154, a shank 155 that is fitted in the hole 153, a flange 156, and a distal portion 157. The distal portion is flared from the region of the flange to the free end of the pin and, thus, takes the shape of a truncated cone. The edge 158 of the hole 129 that receives the distal portion of the pin is beveled at an angle corresponding to the angle of flare of the distal portion to provide a reentrant surface that is engaged by the distal portion. With tension on the elements of the lock portion when the protector is locked around a pipe, the pin is firmly held in the female recess 129 against radial displacement therefrom. The angle of the beveled parts may be from about 15° to 25°, more or less, to a radius of the protector that intersects the beveled parts.

To remove the protector PP' from the pipe $P'_2$, a wedge is driven between the female lock plate 125 and the male lock plate 132 to force these lock plates apart. After the pins 136 have been withdrawn from the holes 129, the protector is allowed to expand to its relaxed condition. The ends of the protector are then manually separated, and the protector is removed from around the pipe.

The pipe protector PP′, as well as the previously described pipe protector PP, can be easily removed from the pipe by but one workman, who drives the wedge and then manually removes the protector from the pipe. It is not necessary to have a second workman manipulate an installation tool to relieve the tension from the lock parts of the protector, as is required with some heretofore known types of pipe protectors, while the one workman withdraws a lock pin from opposed loops carried by the ends of the metallic insert of the protector.

The insert 111 of the protector PP′ serves purposes and provides advantages similar to those set forth hereinbefore with reference to the insert 11 of the first-described form of the invention.

Although two forms of pipe protector according to the invention have been shown and described, it will be understood that such forms are illustrative of the invention and not limitative thereof. Various modifications may be made in the pipe protectors of the invention without departing from its spirit and scope as defined in the claims, which should be interpreted as broadly as the prior art will permit.

As required by the Patent Statutes, the applicant has set forth herein the best mode contemplated by him for carrying out his invention.

I claim:

1. A pipe protector for use on oil well drill pipe and the like comprising:

a. a longitudinally split, generally cylindrical band of spring steel;

b. a first plate of strong, tough steel;

c. first means affixing said first plate to one end of said band with a portion of said first plate extending beyond said one end;

d. a second plate of strong, tough steel;

e. second means affixing said second plate to the other end of said band with a portion of said second plate extending beyond said other end;

f. radially projecting, longitudinally extended, discrete locking means of strong tough steel affixed to said portion of said first plate and having a width in the circumferential direction substantially greater than its thickness in the radial direction;

g. said portion of said second plate providing longitudinally extended, radial locking recess means adapted to receive said locking means;

h. said band being adapted to be circumferentially contracted to move said plates relative to one another and to slide said locking means along a surface of said second plate until said locking means snaps into said locking recess means and portions of the opposed circumferential surfaces of said plates are in overlapping relation;

i. said locking means and said locking recess means having generally radial faces adapted to abut each other when said locking means is disposed in said locking recess means to prevent circumferential expansion of said band;

j. a longitudinally split, annular collar of pliant, elastic material substantially encasing said band and said plates, the material of said collar terminating short of said overlapping portions of the opposed circumferential surfaces of said plates to expose said portions; and k. means engageable by an implement for contracting and locking said collar in tightly gripping disposition around a pipe.

2. A pipe protector as defined in claim 1, including fastener means for affixing said locking means to the extending portion of said first plate.

3. A pipe protector as defined in claim 1, wherein said locking recess means comprises longitudinal slot means and said locking means comprises a longitudinal bar, and fastener means for affixing said bar to said first plate.

4. A pipe protector as defined in claim 3, wherein said transverse surfaces adapted to abut each other to prevent circumferential expansion of said band comprise longitudinal surfaces on said slot means and on said bar, said longitudinal surfaces being disposed at an acute angle to an intersecting radius so that one of said longitudinal surfaces lies radially inward of the other of said longitudinal surfaces.

5. A pipe protector as defined in claim 1, wherein said means affixing said plates to the ends of said band comprise respective longitudinal rows of rivets, and longitudinal reinforcing strips respectively fastened to said band by said rows of rivets.

6. A pipe protector as defined in claim 5, wherein said means for contracting and locking said collar comprise holes through said band adjacent to said respective reinforcing strips.

7. A pipe protector as defined in claim 1, wherein said extending portion of said second plate has a ramp at its free longitudinal edge.

8. A pipe protector as defined in claim 1, wherein said locking recess means comprise a plurality of circular aperture means, said locking means comprise a corresponding plurality of pins, and said surfaces adapted to abut each other to prevent circumferential expansion of said band comprise radially diverging portions on said pins and complementary surfaces on said circular aperture means.

* * * * *